United States Patent [19]

Sato

[11] 4,265,176

[45] May 5, 1981

[54] CLOG PREVENTIVE DEVICE FOR LABEL PRINTING AND APPLYING MACHINE

[75] Inventor: Yo Sato, Tokyo, Japan

[73] Assignee: Kabushiki Kaisha Sato Kenkyusho, Japan

[21] Appl. No.: 44,659

[22] Filed: Jun. 1, 1979

[51] Int. Cl.[3] ..... B41F 35/00; B41K 5/02

[52] U.S. Cl. ..... 101/292; 226/196; 242/76; 101/291; 83/922; 156/389

[58] Field of Search ..... 83/922, 186; 226/196; 242/76; 156/324, 543, 542, 389, 344, 584; 101/288, 291; 400/134.5, 134.6

[56] References Cited

U.S. PATENT DOCUMENTS

| | | | |
|---|---|---|---|
| 2,196,684 | 4/1940 | Rodder et al. | 242/76 |
| 2,616,690 | 11/1952 | Maringx | 226/196 |
| 3,289,803 | 12/1966 | Pedersen | 400/134.5 |
| 3,353,432 | 11/1967 | Philippi | 83/922 |
| 3,424,043 | 1/1969 | Martin | 83/168 |
| 3,446,410 | 5/1969 | Brose | 226/196 |
| 3,588,346 | 6/1971 | Ramig | 242/76 |
| 3,888,429 | 6/1975 | Mack | 226/196 |
| 4,026,758 | 5/1977 | Sato | 156/584 |
| 4,149,462 | 4/1979 | Sato | 101/288 |

*Primary Examiner*—William Pieprz

*Attorney, Agent, or Firm*—Ostrolenk, Faber, Gerb & Soffen

[57] ABSTRACT

A clog prevention device is disclosed for use with a label printing and applying machine. The clog prevention device includes a pair of juxtaposed label guide walls which extend longitudinally up from and at both sides of the printing platen. A label receiving recess is formed in the upper surface of the printing platen between the label guide walls and that recess has a larger width than that of the label strip so that at least both side edges of the label strip may be prevented from contacting the label guide walls of the platen, whereby adhesive at the edges of the label strip does not foul the platen. Label relief grooves are also formed along both sides of the label receiving recess for the same reasons. Openings extend through the platen at the edges of the recess in the upper surface of the platen so that label chips formed when the label strip is pierced or punched during label strip feeding can move away from the label strip. A label receiving recess in the underside of the platen is narrower than the recess on the upper surface and the underside recess guides the separated carrier paper past the platen and centers the label strip over the platen.

13 Claims, 9 Drawing Figures

CLOG PREVENTIVE DEVICE FOR LABEL PRINTING AND APPLYING MACHINE

BACKGROUND OF THE INVENTION

1. Field of the Invention

The present invention relates to a label printing and applying machine, usually of the portable or desk type, and particularly to a clog prevention device for protecting the feed path of the label printing and applying machine from becoming clogged, and more particularly, to protect the platen of the label printing and applying machine from being fouled by the adhesive which frequently flows out of the side edges of the label strip and by the chips that have been punched out of the label strip.

2. Description of the Prior Art

Conventionally, the printing platen of a label printing and applying machine has a guide recess formed in its upper surface. The recess has substantially the same width as the continuous label strip that passes over the platen upper surface while the side walls of the recess continuously contact both side edges of the label strip.

In the event, for example, the label printing and applying machine is used during the summer, and particularly in the tropics or in an area of higher temperature than usual, or if the storage condition of the continuous label strip is bad, the adhesive will frequently flow out of both side edges of the label strip and then contact and stick to the printing platen. When the adhesive sticks to both of the guide walls that define the guide recess of the printing platen, it obstructs the forward movement of the label strip.

If the adhesive that stuck to the guide walls of the platen grows into a lump of adhesive, the continuous label strip will fail to maintain its horizontal orientation upon the printing platen and thereby form a raised portion, which deteriorates the quality of the printing on the label strip.

Moreover, in the label guide recess of the printing platen, a residue of label material is deposited, formed, for example, of label chips, which are produced when the cuts and perforations of the labels and carrier paper are formed in the label strip. This label material residue will also provide an obstacle against the movement of the label strip.

SUMMARY OF THE INVENTION

It is therefore an object of the present invention to provide a clog prevention device for use with a label printing and applying machine, which device is free from the drawbacks of the prior art.

Another object of the invention is to provide a clog prevention device which eliminates problems at the printing platen which are caused by emission of the adhesive that secures the labels and by the label material residue.

It is a further object of the invention to ensure the smooth feed of a continuous label strip.

The present invention teaches a clog prevention device for use with a label printing and applying machine. The machine includes a printing platen for guiding a continuous strip of labels, wherein the label strip is comprised of a series of self-adhesive labels which are secured on a strip of carrier paper by means of an adhesive. The clog prevention device comprises a pair of juxtaposed label guide walls formed to longitudinally extend at the both sides of the printing platen. Label relief means prevent at least both label strip side portions from contacting the label strip guide walls of the platen. The label relief means comprise the guide walls being wider than the label strip, so that the label strip and the adhesive on its edges do not touch the guide walls. Appropriate means hold the label strip over the platen and spaced from both guide walls.

Also, relief channels for removing discarded pieces of label material are provided along the label guide walls of the platen.

Other objects and features of the invention will become apparent from the following description and accompanying drawings.

DESCRIPTION OF THE PREFERRED EMBODIMENTS

Figure 1:
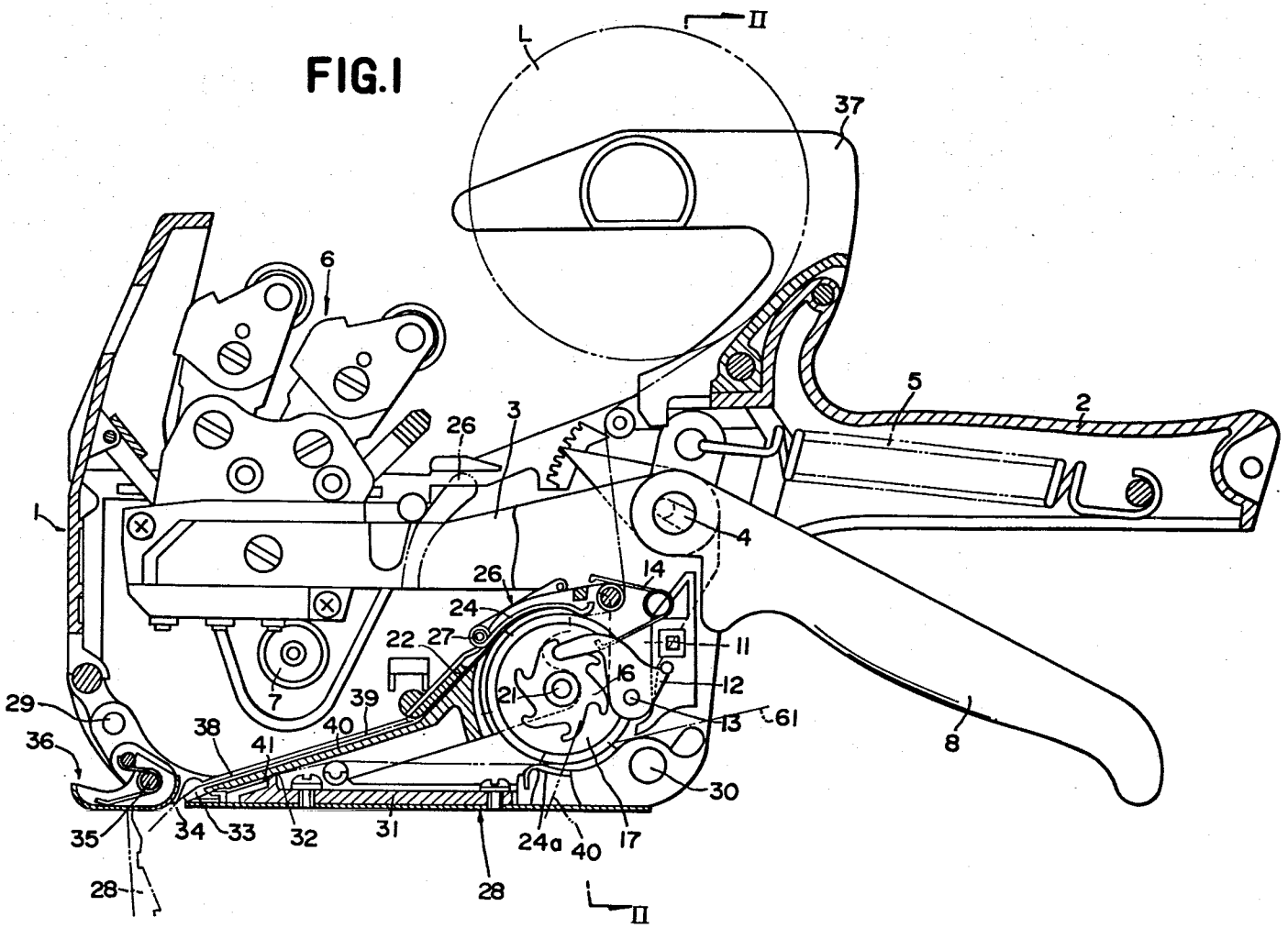
FIG. 1 is a partially sectional, side elevational view showing a label printing and applying machine equipped with a clog prevention device of the invention.

Before describing the clog prevention device according to the present invention, a label printing and applying machine of portable type is generally described with reference to FIGS. 1 and 2.

A pair of machine frames 1 are provided. A printing head carrying lever 3 comprised of a pair of side plates has its trailing (right hand) end hinged by a pivot pin 4 to an upper trailing end portion of the pair of machine frames 1 such that the lever 3 is biased upward or clockwise by the biasing force of a return spring 5. A printing head 6 is carried on the leading (left hand) end portion of the head carrying lever 3. An inking roller 7 is operated to apply ink to the type bearing surfaces of the printing head 6. A hand lever 8 for being manually squeezed toward and released from a grip lever 2 on the frame 1 is made integral with the printing head carrying lever 3.

Figure 2:
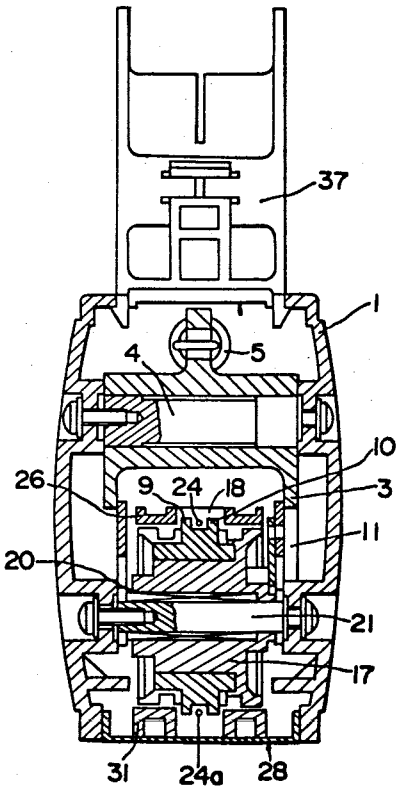
FIG. 2 is a section taken along line II—II of FIG. 1.

Referring to FIG. 2, there is a feed roller 17 for feeding a continuous strip of labels L. On its circumference, roller 17 has two annular rows of radially projecting feed teeth 9 and 10. There is a pressure groove 18 defined between the feed teeth 9 and 10. A one-way clutch 20 permits the feed roller 17 to rotate only in the label strip feeding direction. The feed roller 17 is mounted on its shaft 21 which in turn is pivotally mounted on the machine frames 1.

Referring to FIGS. 1 and 2, there is hinged a rachet pawl 12 hingedly connected to the side plate 11, which depends from the lower rear portion of the head carrying lever 3. The pawl 12 is normally biased to rotate counter-clockwise in FIG. 1 by the biasing force of a torsion spring 14. A ratchet wheel 16 can be engaged with the ratchet pawl 12 upon the releasing of the grip on the hand lever 8, and this turns the feed roller 17 intermittently by one pitch between annularly adjacent feed teeth 9 and 10.

Figure 3:
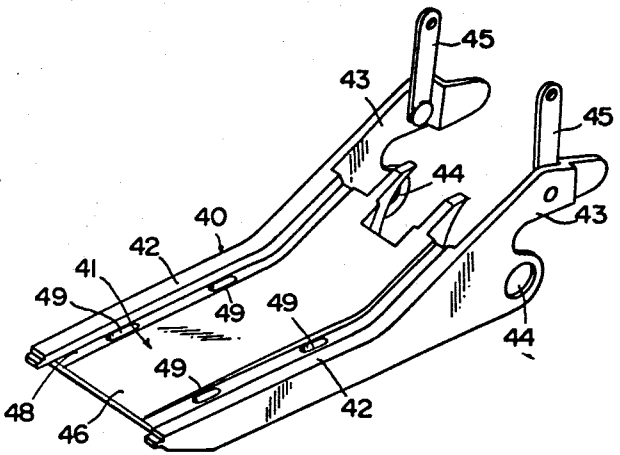
FIG. 3 is a perspective view showing a printing platen which constitutes a major portion of the present invention.

Turning to FIG. 3, there is hingedly attached to the feed roller 17 a printing platen 40. The role of the platen in the clog prevention device according to the present invention will be described later. The printing platen 40 is arranged between the machine frames 1. The platen includes an upper platen surface 41 having a recessed cross-section which is defined by a pair of opposed label guide walls 42 which are slightly taller than the thickness of the continuous label strip L. The printing platen 40 has a knife edge shape at its leading (left hand) end. The trailing end of the printing platen 40 is extended upwardly and rearwardly to form a pair of arm plates 43 at both sides of the platen. Below the arm plates 43, a pair of shaft holes 44 are formed toward the rear of the platen. The shaft 21 of the feed roller 17 is fitted into the holes 44. A pair of connecting members 45 are mounted to and extend above the arm plates 43. The members 45 are hingedly connected to a laterdescribed label holding member 26 by means of a pin 27.

Figure 4:
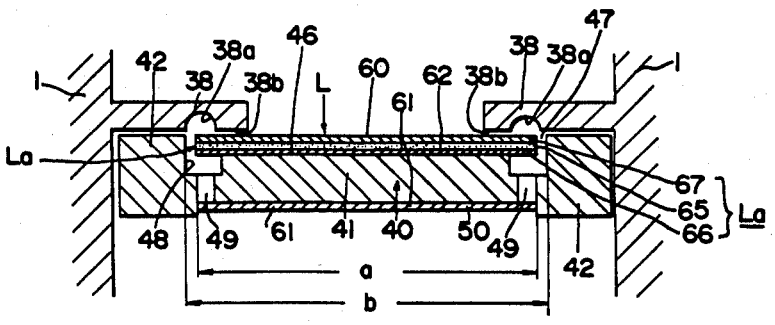
FIG. 4 is a cross-sectional view showing the relationship between the platen according to a first embodiment and a label strip.

Returning to FIG. 1 and turning to FIG. 4, there is a pair of label holding members 38, which form accessory parts of the clog prevention device. The members 38 are comprised of shelf-shaped beams which extend inwardly from the machine frames 1. Referring to FIG. 3, the label guide walls 42 of the printing platen 40, which are wider apart than the width of the label strip, normally abut against the lower sides of the label holding members 38. Due to the height of the walls 42, this forms a passage 39 which is thin enough to barely admit the continuous label strip L.

A label holding member 26 is arranged above the feed roller 17. The member 26 is of an arcuate shape. It is elastically biased toward the feed roller 17 by a spring member 24. The label holding member 26 is formed at its forward under side with an abutment surface, which is in abutment contact with the upper sides of the label guide walls 42 of the printing platen 40. This defines a label strip feed passage 22 which is slightly thicker than the continuous label strip L.

A bottom cover 28 is located below the machine frames 1. The leading end of the cover 28 is hinged to the machine frames 1 by a pivot pin 29 and the cover can be opened clockwise. The trailing end of the cover 28 is retained on the machine frames 1 by a locking device 30. The center portion of the bottom cover 28 integrally supports a carrier or backing paper strip guide member 31. The inclined carrier paper receiving surface 32 of the guide member 31 is positioned below the leading end portion of the label holding members 38, thus forming a peeling turning portion 33 which has restricted clearance between the carrier paper receiving surface 32 and the label holding members 38. A carrier paper holding spring 24*a* is forced into engagement with the pressure groove 18 which is formed between the feed teeth 9 and 10 carried on the feed roller 17. In front of the printing platen 40, there is a label applying device 36 which is pivotally supported on a pivot pin 35 in the vicinity of the forward label outlet 34. Above the machine frames 1, there is a label roller holder 37 which is used to hold the continuous label strip L stored in the rolled shape.

Figure 9:
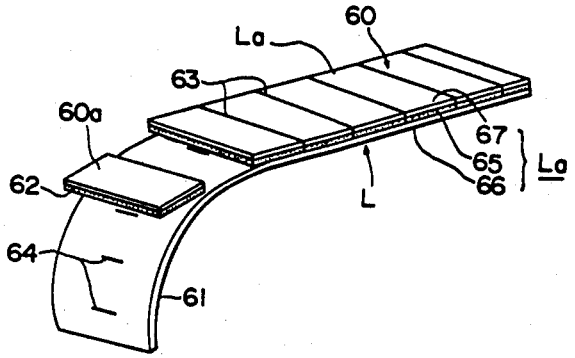
FIG. 9 is an enlarged perspective view showing a continuous strip of labels, comprising self-adhesive labels and their carrier paper which are adhered temporarily.

Turning to FIG. 9, the continuous label strip L to be used with the clog prevention device is comprised of a series of self-adherent labels 60 and a strip of carrier paper 61 which carries the labels 60, to which the labels are adhered by an adhesive 62 which is applied to the backs of the labels 60. In order that the label strip L may be advanced by its engagement with the feed teeth 9 and 10 of the feed roller 17, the backing paper strip 61 has a series of perforations 64 through it at positions corresponding to the cuts 63 formed between adjacent labels 60*a*. To facilitate the separation of the labels 60*a* having the adhesive 62, a parting agent, such as silicone oil, is applied to the surface of the backing paper strip 16. Both side portions La of the label strip L are used merely to illustrate the side edges 65, lower side portions 66 and upper side portions 67, as is also shown in FIG. 4.

When the printing of the labels 60 of the label strip L is to be performed, the hand lever 8 is squeezed toward the grip lever 2 so that the printing head carrying lever 3 is turned counter-clockwise downward about the pivot pin 4. In response to the downward rotation of the head carrying lever 3, the inking roller 7 is turned over the type bearing surface of the printing head 6 so as to supply the same with ink. As squeezing of the hand lever 8 proceeds further, the printing head 6 is finally brought into abutment contact with one of the labels 60, which has been fed onto the printing platen 41 by that time, so that that label is printed with the type bearing surface.

Feeding of the label strip L is performed by releasing the squeezed hand lever 8. During this release, the label strip L in engagement with the feed teeth at the upper side of the feed roller 17 is fed by the intermittent rotation of the feed roller 17. As a result, the foremost printed label 60*a* is advanced upon the printing platen 41 to the leading end thereof. At the peeling turning portion 33, the foremost label 60*a* thus advanced is peeled from the carrier paper 61, due to its own rigidity, by the turning action of a small loop of the carrier paper 61. The carrier paper 61 is advanced along the lower side of the printing platen rearwardly of the hand labeler until it again engages the feed teeth 9 and 10 of the feed roller 17 at the lower side thereof.

The peeled label 60*a* is held unbent and directed outwardly by the pushing actions of both of the label holding members 38 arranged above the printing platens 41 and the carrier paper receiving surface 32 formed below the printing platen 41. After having been separated from the carrier paper 61, the foremost label 60*a* is adhered to a commodity, or the like, by the label applying device 36.

The clog prevention device according to the present invention is now described with reference to FIGS. 4 to 8.

Figure 5:
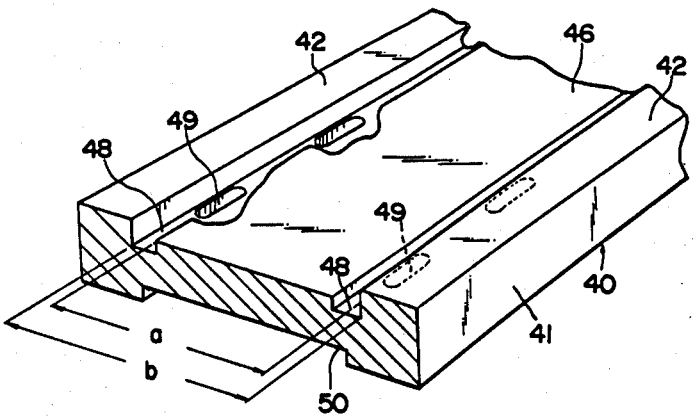
FIG. 5 is a perspective view showing the platen of FIG. 4.

A first embodiment of the device is shown in FIGS. 4 and 5. The printing platen 40 is formed with a label receiving recess 46 having a larger width b than the width a of the continuous label strip L. The label receiving recess 46 is defined between the opposed label guide walls 42 which extend longitudinally of the printing platen 41. As a result, the label side portions La, and more specifically, the side edges 65 of the label strip L can be prevented from contacting the label guide walls 42, thus leaving clearances 47 on both sides.

According to a second feature of the present invention, a pair of elongated label relief grooves 48 are formed in the upper surface of the printing platen 41 along both sides of the label receiving recess 46. The grooves 48 are cut deeper than the recess 46. As a result, both lower side portions 66 of the label strip L can be prevented from contacting the platen at the label receiving recess 46.

According to a third feature of the present invention, the label holding members 38, which are above the printing platen 41 and extend inwardly from the machine frames 1, have a pair of elongated label relief grooves 38*a* formed at their lower sides. The grooves 38*a* overlie and are opposed to the respective label relief grooves 48. At its inner lower side, each holding member 38 has a label guide surface 38*b* which will contact the label strip L. As a result, both upper side portions of the label strip L can be prevented from contacting the label holding members 38.

The label holding members 38 are used in the label peeling system described above, in which the continuous label strip L is subjected to the pushing and pulling actions of the feeding roller 17. However, the label holding members 38 can be dispensed with if pins are provided either at the leading end or in the longitudinal direction of the printing platen 41 so that the labels may be peeled from the label strip L by pulling the carrier paper 61 only.

According to a fourth feature of the present invention, because the label receiving recess 46 in the upper surface of the printing platen 41 has a larger width b than the width a of the continuous label strip L, the label strip L may meander while being advanced because its side portions La are prevented from contacting the label guide walls 42 of the platen. To counter this, the printing platen is formed at its lower side with a carrier paper guide recess 50 which has the same width as the carrier paper 61 that is separated from the labels 60. This helps label strip L to advance straight as a whole upon the printing platen 41.

According to a fifth feature of the present invention, both label relief grooves 48 extending in the longitudinal direction of the printing platen 41 are formed with two series of through slots 49 which are arranged at a suitable spacing from one another. A label residue, such as chips, is produced when the cuts 63 that temporarily connect the labels 60*a* of the label strip L and that define the perforations 64 of their carrier paper 61 are formed, and this residue sticks to the label strip L. The residue of the labels which might otherwise drop down upon the printing platen 41 from the continuous label strip L, so that the residue would foul the platen, can instead be discharged to the outside through the through holes 49.

Figure 6:
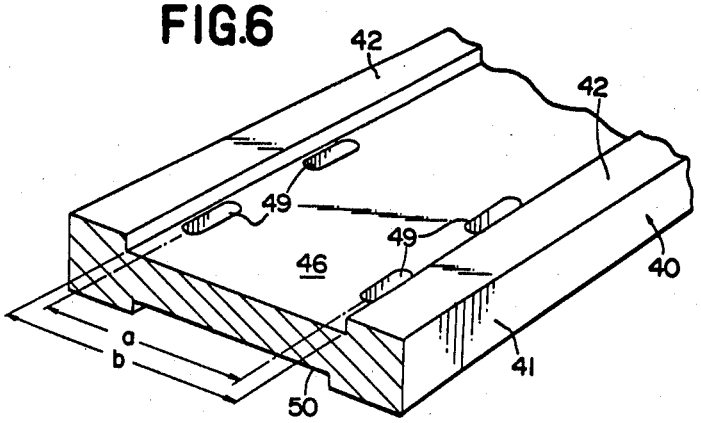
FIGS. 6 to 8 are views similar to FIG. 5 but show second, third and fourth embodiments of the invention, respectively.

The second embodiment of the present invention is shown in FIG. 6. Similarly to the first embodiment, the printing platen 41 also has its upper platen surface formed with the label receiving recess 46 having a larger width b than the width a of the continuous label strip L. The upper platen surface is a flattened label sliding surface without side grooves, like grooves 48. Moreover, the label receiving recess 46 is also formed along both of its sides with two series of through holes 49, which are arranged at a suitable spacing in the longitudinal direction so as to permit the discharge of the label residue. The printing platen 41 is also formed at its lower side with the carrier paper guide recess 50 for the carrier paper 61.

Figure 7:
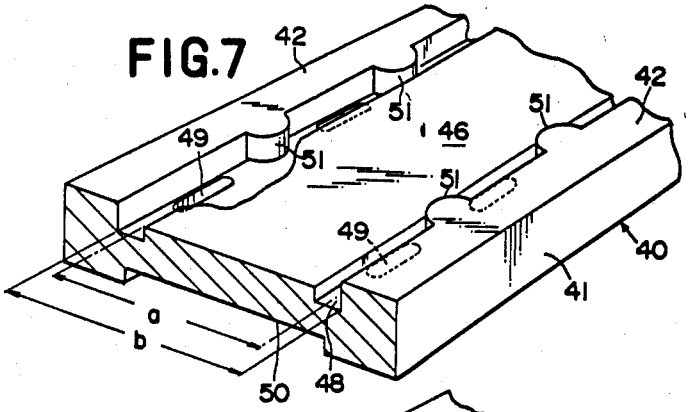

According to the third embodiment of the present invention shown in FIG. 7, the printing platen 41 has a similar construction to the first embodiment. It includes two series of label guide projections 51 which project from the label guide walls 42 so as to guide the label strip L in a discontinuous manner. The label guide projections 51 face each other at a spacing equal to the width a of the label strip L so that they can contact the side edges 65 of the label strip L thereby to stabilize its forward movement.

Figure 8:
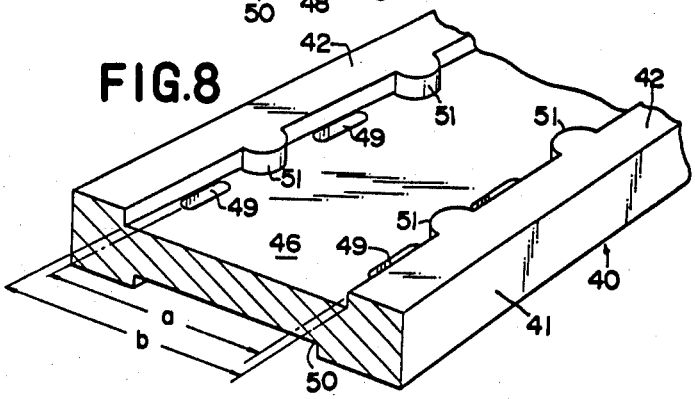

In the fourth embodiment shown in FIG. 8, the printing platen 41 has a similar construction to the second embodiment, but it includes the label guide projections 51 of the third embodiment, which also project from the label guide walls 42 so as to guide the label strip L in a similarly discontinuous manner.

As has been described hereinbefore, the clog prevention device according to the present invention produces the following advantages:

(1) Since the label receiving recess which is formed in the upper surface of the printing platen between the juxtaposed label guide walls has a larger width than the continuous label strip, the label strip can be prevented from having its side edges contact the label receiving recess while it is being advanced. As a result, even if adhesive material flows out of both side edges of the complete label strip, the label strip can be prevented from being stuck to the label guide walls on the top of the platen so that smooth label feed can be ensured to prevent clogging of the platen with adhesive.

(2) When the label receiving recess is formed along both sides with two longitudinal rows of label relief grooves, even both lower side portions of the label strip can be prevented from contacting the label receiving recess. As a result, the adhesive can be effectively prevented from being stuck to the platen.

(3) When the label holding members arranged above the printing platen are also formed with a pair of elongated label relief grooves, the label strip can be forced into contact with the upper surface of the printing platen so that the both upper side portions of the label strip can be prevented from contacting the label holding members, especially where a label peeling system in which the label strip is subjected to the pushing and pulling actions is used. As a result, the adhesive can be further effectively prevented from being stuck.

(4) When the printing platen is formed at its lower side with a carrier paper guide recess which has the same width as the carrier paper of the label strip, the label strip can be advanced straight over the platen as a whole by means of the carrier paper being guided in the guide recess even though the label strip is not guided at its sides upon the upper surface of the printing platen.

(5) Furthermore, either the label relief grooves or the label receiving recess of the printing platen are formed at both side edges with two series of through slots. Thus, the label residue, which might otherwise be left on the platen, can be discharged to eliminate problems.

What is claimed is:

1. A clog prevention device for use with a label printing and applying machine for preventing clogging of the feed path of a label strip over the platen of the label printing and applying machine; said clog prevention device comprising:

a platen for use in the label printing and applying machine; said platen including an upper surface over which passes a complete label strip, comprised of a series of labels and a supporting carrier paper for the labels, and adhesive between the labels of the series and the supporting carrier paper, the individual labels of the series thereof are printed on said platen;

said platen further includes a forward tip, around which the carrier paper may be wrapped and comprises an underside past which the carrier paper may be passed following separation therefrom of the previously adhered labels of the series thereof;

a passage along said platen upper surface defined by side walls extending longitudinally along said platen; label strip relief means associated with said platen for acting upon the label strip as it moves through said passage for preventing the label strip from contacting said side walls of said passage;

said relief means further comprising a carrier paper guide recess in said platen underside which is defined by and between opposed underside side walls; and said carrier paper guide recess having a width less than the width of said passage and substantially the same width as the width of the carrier paper for guiding the carrier paper while contacting both side edges of the carrier paper, whereby the complete label accumulation strip may be guided over said platen upper surface through being guided at said underside of said platen.

2. The clog prevention device of claim 1, wherein said relief means comprises said side walls defining said passage having a greater width than the width of the complete label strip passing through said passage.

3. The clog prevention device of claim 2, further comprising a respective series of through holes at each side of said passage and placed inwardly of each said side wall of said passage, and said through holes extending through said platen, for discharging therethrough label residue.

4. The clog prevention device of either of claims 1 or 2, wherein said relief means comprises a respective longitudinal relief groove in said passage and placed inwardly of each said side wall; each said relief groove extending deep enough into said platen to prevent the lower side of the edges of the complete label strip from contacting said platen along said passage.

5. The clog prevention device of claim 4, further comprising a respective series of through holes at each said relief groove and extending through said platen for discharging therethrough label residue.

6. The clog prevention device of claim 2, wherein said relief means further comprises a respective series of label strip guide projections extending into said passage in respective directions inwardly from each said passage side wall; the said projections on opposite sides of passage being spaced apart at a spacing for stably guiding the complete label strip while contacting the edges thereof.

7. A label printing and applying machine, comprising: a machine frame; said clog prevention device of claim 1; printing means movable with respect to said platen for printing a label then on said platen; means for feeding a label strip over said platen.

8. The label printing and applying machine of claim 7, further comprising a pair of label holding members supported on said frame above said platen at both sides of said platen and each having a lower side opposed to said platen, whereby a label strip may be captured between said label holding members and said platen.

9. The label printing and applying machine of claim 8, wherein said label holding member lower sides are each provided with a respective longitudinally extending label relief groove, extending longitudinally along said passage in said platen and both being so placed and of such a depth as to prevent the upwardly facing sides of the complete label strip at the side edges of the complete label strip from contacting the label holding members.

10. A label printing and applying machine comprising: a machine frame; said clog prevention device of claim 4; printing means movable with respect to said platen for printing a label then on said platen; means for feeding a label strip over said platen.

11. The label printing and applying machine of claim 10, further comprising a pair of label holding members supported on said frame above said platen at both sides of said platen and each having a lower side opposed to said platen, whereby a label strip may be captured between said label holding members and said platen.

12. The label printing and applying machine of claim 11, wherein said label holding member lower sides are each provided with a respective longitudinally extending label relief groove, extending longitudinally along said passage in said platen and both being so placed and of such a depth as to prevent the upwardly facing sides of the complete label strip at the side edges of the complete label strip from contacting the label holding members.

13. A clog prevention device for use with a label printing and applying machine for preventing clogging of the feed path of a label strip over the platen of the label printing and applying machine; said clog prevention device comprising:

a platen for use in the label printing and applying machine; said platen including an upper surface over which passes a complete label strip, comprised of a series of labels and a supporting carrier paper for the labels, and adhesive between the labels of the series and the supporting carrier paper, the individual labels of the series thereof are printed on said platen;

a passage along said platen upper surface defined by side walls extending longitudinally along said platen;

label strip relief means associated with said platen for acting upon the label strip as it moves through said passage for preventing the label strip from contacting said side walls of said passage; said relief means comprises said side walls defining said passage having a greater width than the width of the complete label strip passing through said passage;

a respective series of through holes at each side of said passage and placed inwardly of each said side wall of said passage, and said through holes extending through said platen, for discharging therethrough label residue.

* * * * *